US007536889B1

(12) United States Patent
Mueller

(10) Patent No.: US 7,536,889 B1
(45) Date of Patent: May 26, 2009

(54) ROTARY ROLLING MACHINE

(76) Inventor: Thomas L. Mueller, 6501 River Farm Dr., St. Louis, MO (US) 63129

( * ) Notice: Subject to any disclaimer, the term of this patent is extended or adjusted under 35 U.S.C. 154(b) by 397 days.

(21) Appl. No.: 11/498,600

(22) Filed: Aug. 4, 2006

(51) Int. Cl.
*B21B 1/10* (2006.01)

(52) U.S. Cl. ..... 72/101; 72/452.9

(58) Field of Classification Search ..... 72/101, 72/120, 121, 145, 148, 452.8, 452.9
See application file for complete search history.

(56) References Cited

U.S. PATENT DOCUMENTS 2,617,466 A * 11/1952 Kradoska ..... 72/101
3,015,502 A * 1/1962 Frost et al. ..... 72/101
5,937,694 A * 8/1999 Mueller ..... 72/452.1
6,591,651 B2 * 7/2003 Kutschker et al. ..... 72/101

* cited by examiner

*Primary Examiner*—David B Jones
(74) *Attorney, Agent, or Firm*—Kevin L. Klug; David W. McGuire

(57) ABSTRACT

An improved rotary rolling or bead rolling machine capable of placing beads, crimps, flanges, turns, burrs, elbows, slits, offsets, collars, flats, or other deformations in sheet material. The machine provides a foot operated roller force and motor control and allows an operator to utilize two hands to manipulate the sheet material placed between the rollers. The machine utilizes an air spring or air-stroke actuator to provide substantial roller force in a small volume. The machine further provides roller adjustability whereby a roller may be displaced relative to another roller.

20 Claims, 12 Drawing Sheets

ROTARY ROLLING MACHINE

BACKGROUND OF THE INVENTION

The present invention relates in general to rotary rolling or bead rolling machines for sheet metal beading, flanging, crimping, joining, or other forming operations and more particularly, to an improved rotary machine or bead rolling device which utilizes an air bag or air spring pneumatic force actuator in combination with a unique variable pressure delivery control apparatus in order to provide precise and controlled force upon a mated pair of rollers.

It is well understood within the mechanical arts that deformation of sheet metal with ridges, bends, textures, beads (i.e. substantially semicircular indentations or projections), etc. creates substantial rigidity and strength within the sheet material. That is, flat form sheet metal is very flexible and generally unable to sustain forces perpendicular to the sheet plane without bending. Conventional rotary machines or bead rolling devices typically use a motor driven male and female roller which come together with the sheet metal there between to form a strengthening bead, a crimp, or other form. Unfortunately, the prior art bead rolling devices typically require that the user hold the sheet metal in one hand, use the other hand for mechanically controlling the separation between the rollers, and use a footswitch for roller speed control, all at the same time. For example, in a base form the prior art CMZ-7R power rotary machine from Empire Machinery & Supply Corp. of Norfolk, Va. requires the user to manually rotate a crank with a first hand while holding the sheet metal part with another hand during the beading, flanging, or crimping process. When rotated, said crank positions said rollers closer. This prior art technique is at best cumbersome and at worst a safety concern.

The prior art offers a pneumatic air cylinder or air over hydraulic cylinder feed for the aforesaid CMZ-7R. This prior art technique replaces said crank with a diaphragm within a larger metal housing or a hydraulic piston-cylinder, both combined with a linkage ram arrangement. Neither of the aforesaid arrangements provide for user operated force control between said rollers. Instead, said prior art simply provides a mechanical stop which limits the separation between said rollers when pneumatic pressure is applied to said diaphragm or hydraulic pressure is applied to said piston cylinder. This prior art limitation restricts the user's real time control of beading, flanging, and crimping depths, precludes the user from tapering in or gently beginning said bead, flange, or crimp, and further limits or prohibits the user from avoiding a machine stall when an overlapped or thicker material is encountered. Said prior art diaphragm in combination with said metal housing or said piston-cylinder arrangement further comprises a bulky obstruction positioned at the top of or above the rotary machine frame which restricts the user's work or sheet material visibility and ability to maneuver the material requiring beading, flanging, crimping, or other operations. This prior art piston-cylinder arrangement is also unnecessarily complex as it attaches to the top of said rotary machine whereby a ram attached with said piston may feed through said machine frame onto a top roller arm housing without incurring lateral forces which will bind said ram.

The present art utilizes a unique combination of a pneumatically actuated air spring or air-stroke actuator (not a piston cylinder arrangement) and a foot operated pressure regulator to control the force, not simply the displacement, between the rollers and the roller feed in real time pursuant to the user's requirement. This combination of force and feed control in a compact user friendly form allows the user to hold the sheet metal or part with two hands while using a single foot controller to control both the force between the rollers and the feed of the rollers. With the present art, the user has more control and convenience of use, i.e. two hand hold on the material, and thereby is able to more safely use the rotary machine and more precisely place and locate the ridges, bends, textures, beads, etc.

The present art utilization of an air spring or air-stroke actuator, typically manufactured by Goodyear® or Firestone®, between the top roller arm housing and machine frame is able to flex relative to its displacement direction, i.e. with said top roller arm housing radial displacement, which eliminates unnecessary mechanical complexity and the prior art obstruction and visibility concerns. This is especially useful for the present art since the top roller housing position, i.e. roller position, is moveable or may be adjustably displaced substantially perpendicular to the rotation plane of said roller. This movability option allows the user to offset the roller positions if desired or necessary. The prior art does not offer said flexibility or adjustability.

In a preferred embodiment, the present art further places a relatively small pressure gauge substantially at or near where the prior art places said diaphragm or piston-cylinder arrangement. The pressure gauge allows the user to observe the user controlled regulated pressure supplied to said air spring or air-stroke actuator as the foot controlled pressure is regulated whereby repeatedly consistent force is applied when forming the ridges, bends, textures, beads, etc.

Accordingly, it is an object of the present invention to provide an improved rotary rolling or bead rolling machine which is able to supply a user controlled regulated variable compressive force between a pair of rollers which form ridges, bends, textures, beads, or other sheet material deformations.

Another object of the present invention is to provide an improved rotary rolling or bead rolling machine which is able to utilize a pneumatic supply or compressed air to provide a roller regulated variable force, said force having a maximum value commensurate with or greater than the prior art hydraulic feed without external hydraulics or the complexity of associated hydraulic pumps and controllers.

A further object of the present invention is to provide an improved rotary rolling or bead rolling machine which utilizes a unique foot operated pneumatic variable pressure regulator which has not heretofore been utilized with rotary machines.

A still further object of the present invention is to provide an improved rotary rolling or bead rolling machine which utilizes the substantial force and compact size of an air spring or air-stroke actuator to provide the force between the machine rollers.

A still further object of the present invention is to provide an improved rotary rolling or bead rolling machine which utilizes a single foot controller which allows a user to control the feed and force between rollers while maintaining two hands free for holding and controlling the work material.

A yet further object of the present invention is to provide an improved rotary rolling or bead rolling machine which provides at least one adjustable roller displacement substantially perpendicular to the rotation plane of said roller whereby a operator's rolling requirements are met.

SUMMARY OF THE INVENTION

To accomplish the foregoing and other objects of this invention there is provided a rotary rolling or bead rolling machine having variable roller force control, roller position adjustability, and a maximum force value between the rollers equivalent to or greater than any prior art rotary machine. The present art with its unique combination of elements, provides the aforesaid benefits in a smaller volumetric package than any of the prior art.

In a base form of a preferred embodiment, the apparatus comprises two rollers each attached onto roller arm shafts which are each held within a respective housing, a frame, an air-stroke actuator between said frame and the top roller arm housing, a motor driving said arm shafts, a foot operated pressure regulator, and the associated pneumatic and electrical control components. When activated via a user's foot, the foot operated pressure regulator provides pneumatic pressure to a pneumatic electrical switch which turns on the motor and further controls the pneumatic pressure supplied to said air-stroke actuator as a function of displacement of said foot operated regulator. As the pressure increases within said air-stroke actuator, the rotating rollers approach or come closer together with the work material there between. As the operator or user continues to displace the foot operated pressure regulator, the force between the rollers increases in relation to said displacement due to an increase in pneumatic pressure within said air-stroke actuator. The variable force feature of the present art allows a user to control bead depth, avoid a machine stall when material thickness increases or material overlaps, and further taper in or gently introduce a bead or other deformation to the work material while utilizing two hands to hold said work material.

An inverter drive such as an Automation Direct model GS1-10P5 or equivalent is used to drive the motor. A variable speed control is provided in conjunction with said inverter drive via a potentiometer which thereby controls the roller speed or rotational velocity and material feed rate. In the preferred embodiment, the inverter drive utilizes a 115 Volt AC single phase power source and converts the single phase to three phase 230 Volt AC power which drives the three phase motor. The pneumatic electrical switch electrically connects between a common and a forward or reverse terminal of the inverter drive to turn on the motor.

The pneumatic components of the present art interface and are controlled by the foot operated variable pressure regulator. The pressure regulator supplies user controlled variable pneumatic pressure to the pneumatic electrical switch and a pilot regulator in a preferred embodiment. The pilot regulator, such as a Numatics® 22 or 32 series or equivalent, simply regulates the value of pneumatic pressure provided to the air-stroke actuator in proportion to the pressure supplied to a pilot port. Alternative embodiments may directly regulate the air pressure within the air-stroke actuator via the foot operated pressure regulator. A flow controller pneumatically connected between the pilot regulator and the air-stroke actuator or airbag limits the rate of approach of the rollers. A quick exhaust pneumatically connected between the flow controller and the air-stroke actuator or airbag assures maximally quick separation of the rollers when the pilot regulator shuts off. That is, the air-stroke actuator or airbag is immediately depressurized. A solenoid valve between the pneumatic source and the pilot regulator provides an additional margin of safety by assuring shutoff of the supply air to the pilot regulator and thus the air-stroke actuator or airbag if the stop switch is depressed or the electrical portion is unpowered.

The present art utilization of an air-stroke actuator or air spring is distinct and advantageous relative to a piston-cylinder or plenum arrangement. An air spring or air-stroke actuator is a commercially available mechanical element or component which typically comprises a rubber bag having an air inlet and mounting plates on each end for attachment. It is a uniquely defined mechanical component which is not equivalent in operation or method of use with a piston-cylinder or plenum form. When pressurized, each end displaces relative to the other. Since force is proportional to air pressure multiplied by cross sectional area, the air spring provides significantly more force than a typical pneumatic cylinder arrangement due to the substantial top, bottom, and side cross sectional area of the rubber bag. A salient advantage of the air spring for the present art is its ability to flex within or perpendicular to its plane of movement without binding concerns. This phenomena is thereby forgiving of misalignments of interconnected components which mate with other components.

The present art utilization of a stem regulator such as the Clippard MAR-1CP with the uniquely small dimensions of approximately 2.3×0.7 inches allows incorporation of a pressure regulation system within a foot operated pressure regulator. The foot operated pressure regulator provides increased pressure proportionally as a plunger of the preferred Clippard stem regulator is depressed. Unlike the prior art, the stem regulator is not simply a pneumatic switch but a true pressure regulator.

For all of the aforesaid pneumatic components, i.e. regulator, valves, switches, or other devices, a pneumatic source is presumed available and able to feed each of the aforesaid components as further described. The aforesaid frame, housings, shafts, regulator housing, and associated components as more fully described herein may be manufactured from a plurality of materials including but not limited to metals and alloys thereof, plastics, and composites. In a preferred embodiment, the frame, housings, shafts, and associated components are manufactured from a steel material and the regulator housing is manufactured from an aluminum material. Although described for a preferred use with sheet metal, the present art may be utilized with any sheet material whether manufactured from metals, plastics, woods, papers, composites, or other materials.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
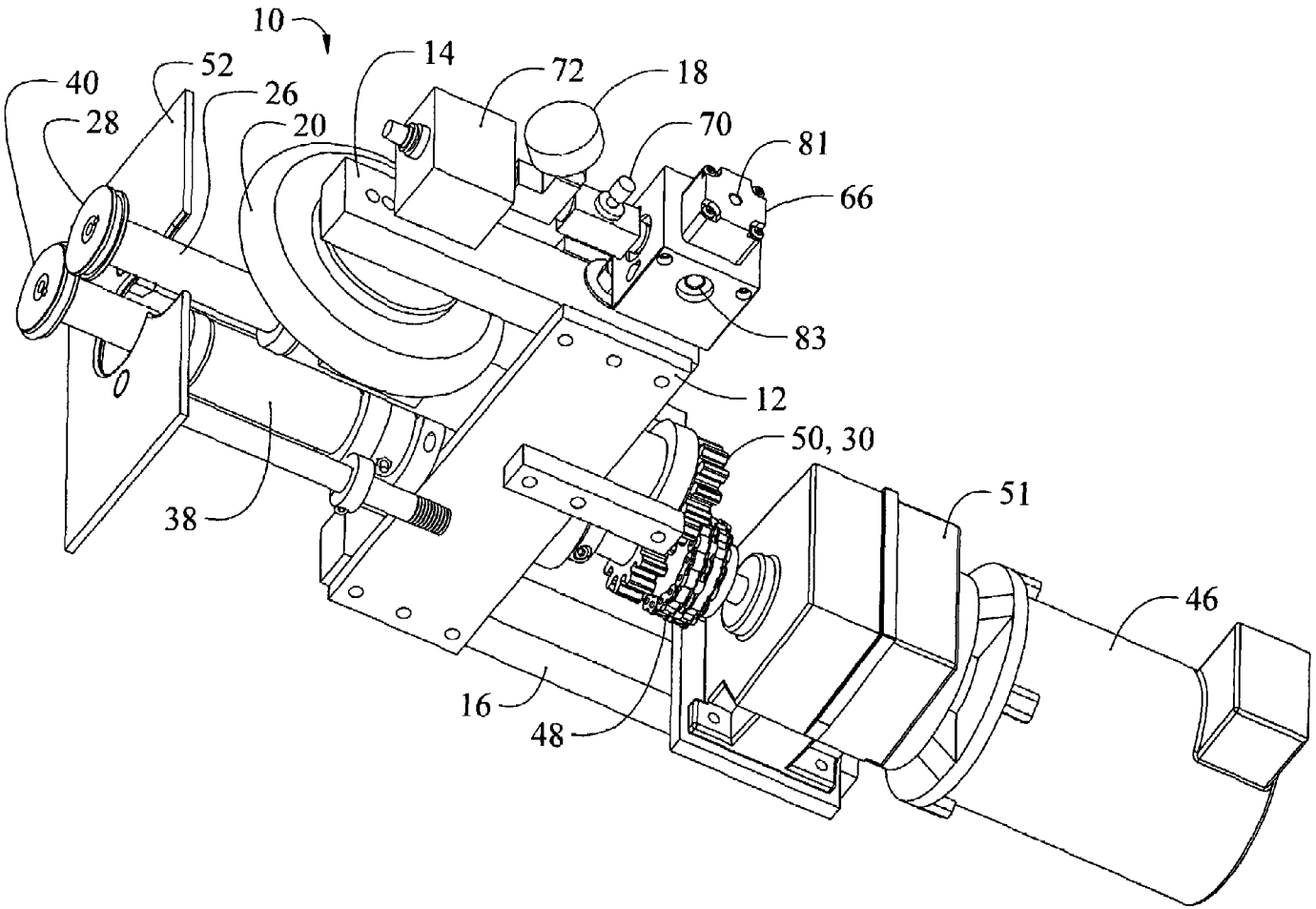
FIG. 1 shows a right perspective view of the improved rotary rolling machine without the foot operated pressure regulator shown.
Figure 2:
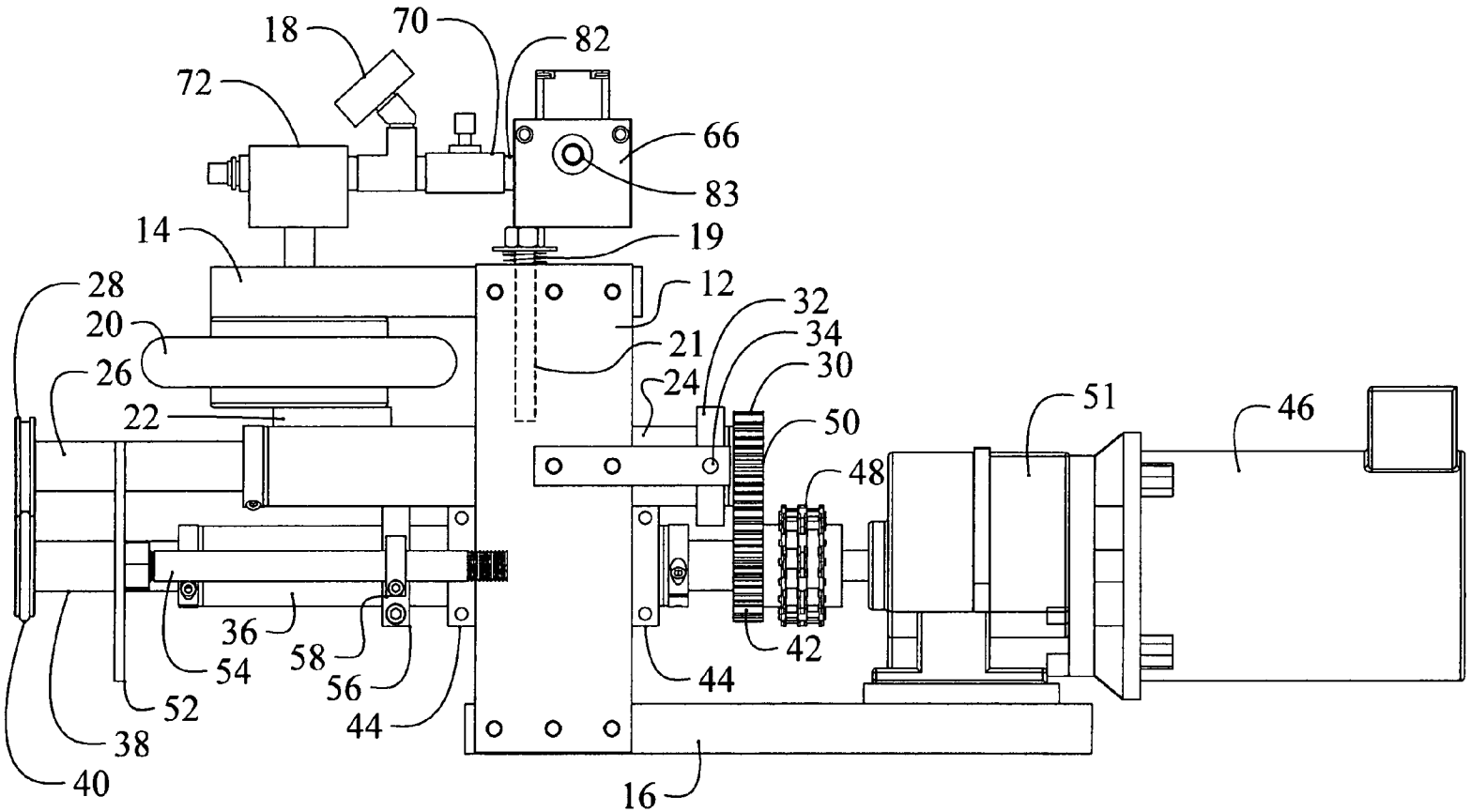
FIG. 2 shows a right side plan view of the improved rotary rolling machine without the foot operated pressure regulator shown.
Figure 3:
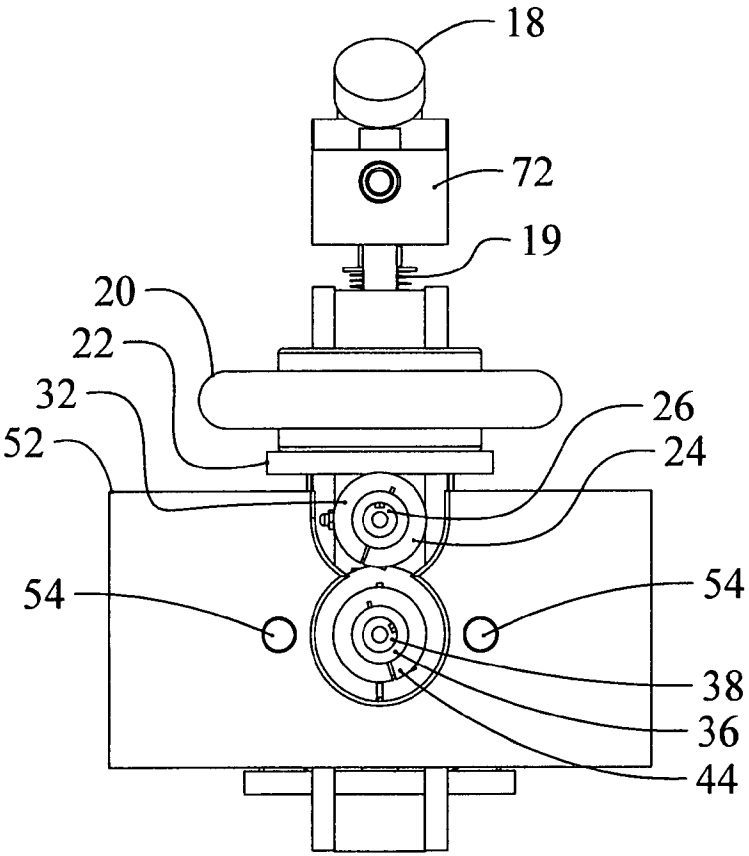
FIG. 3 shows a front side plan view of the improved rotary rolling machine without the foot operated pressure regulator or the top or bottom rollers shown.
Figure 4:
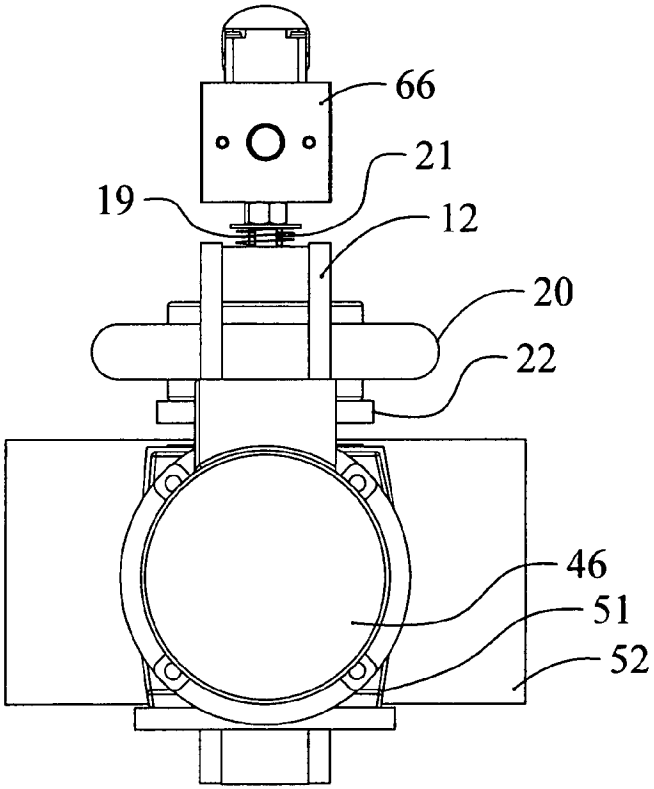
FIG. 4 shows a rear side plan view of the improved rotary rolling machine without the foot operated pressure regulator shown.
Figure 5:
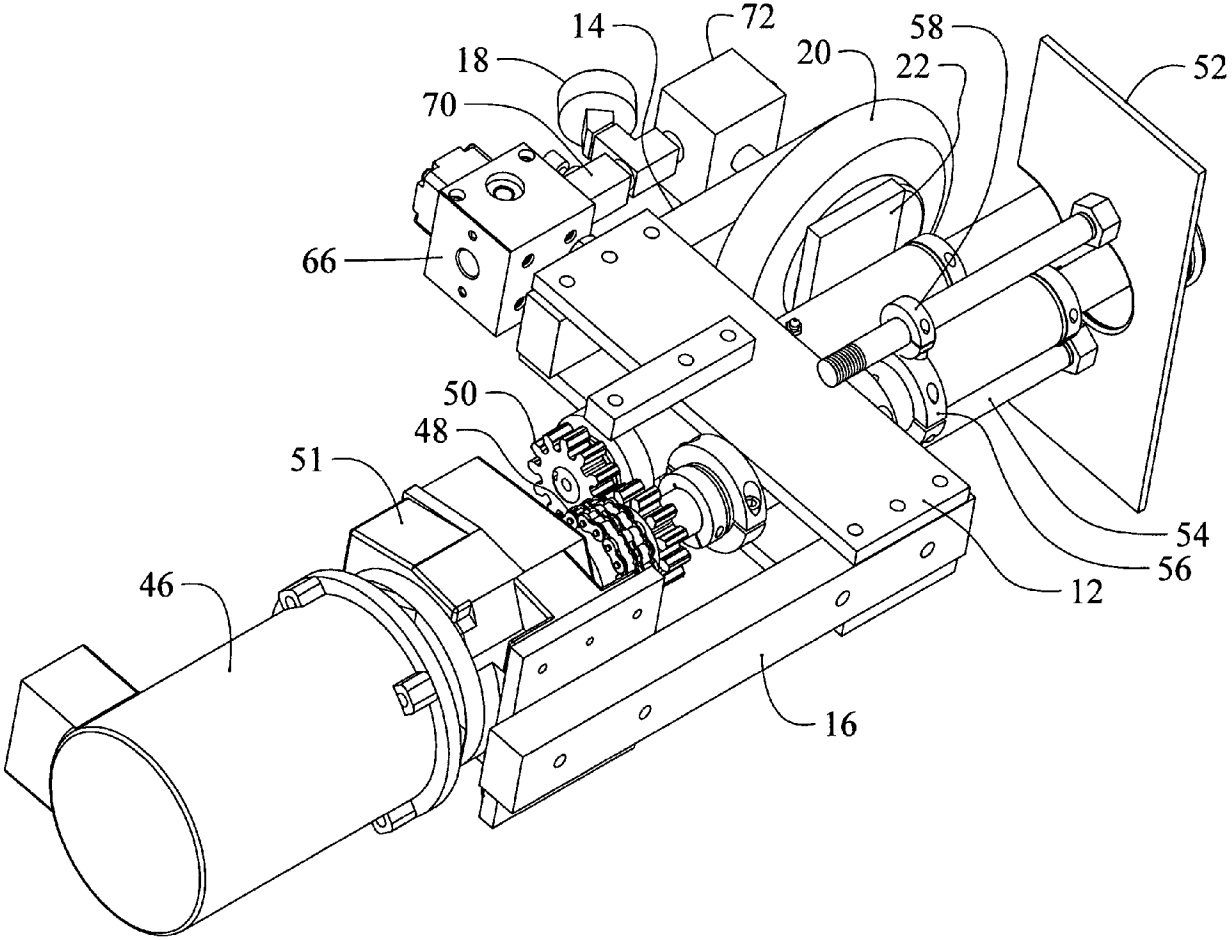
FIG. 5 shows a bottom perspective view of the improved rotary rolling machine without the foot operated pressure regulator shown.
Figure 6:
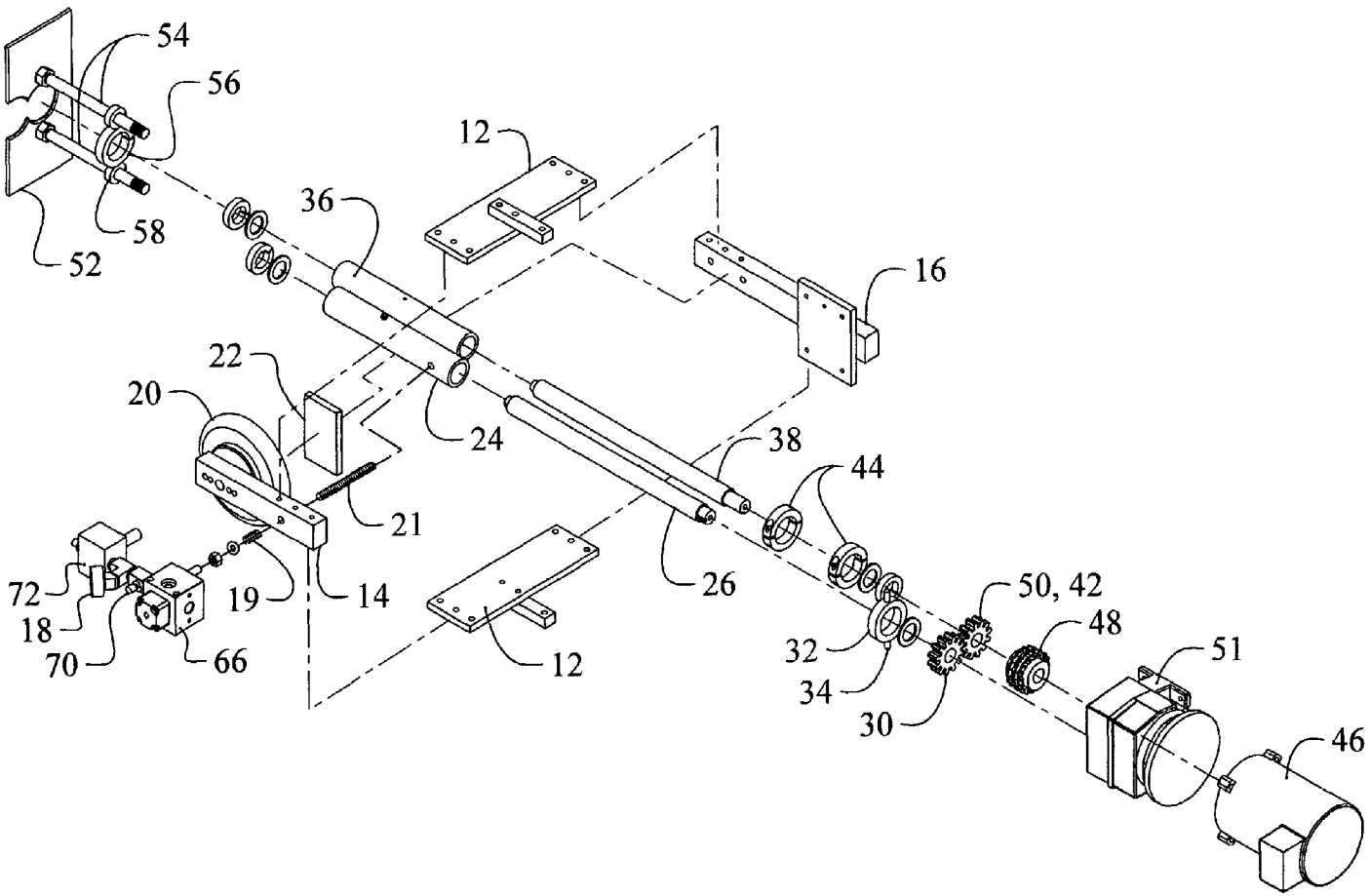
FIG. 6 shows an exploded view of the improved rotary rolling machine without the foot operated pressure regulator shown.
Figure 7:
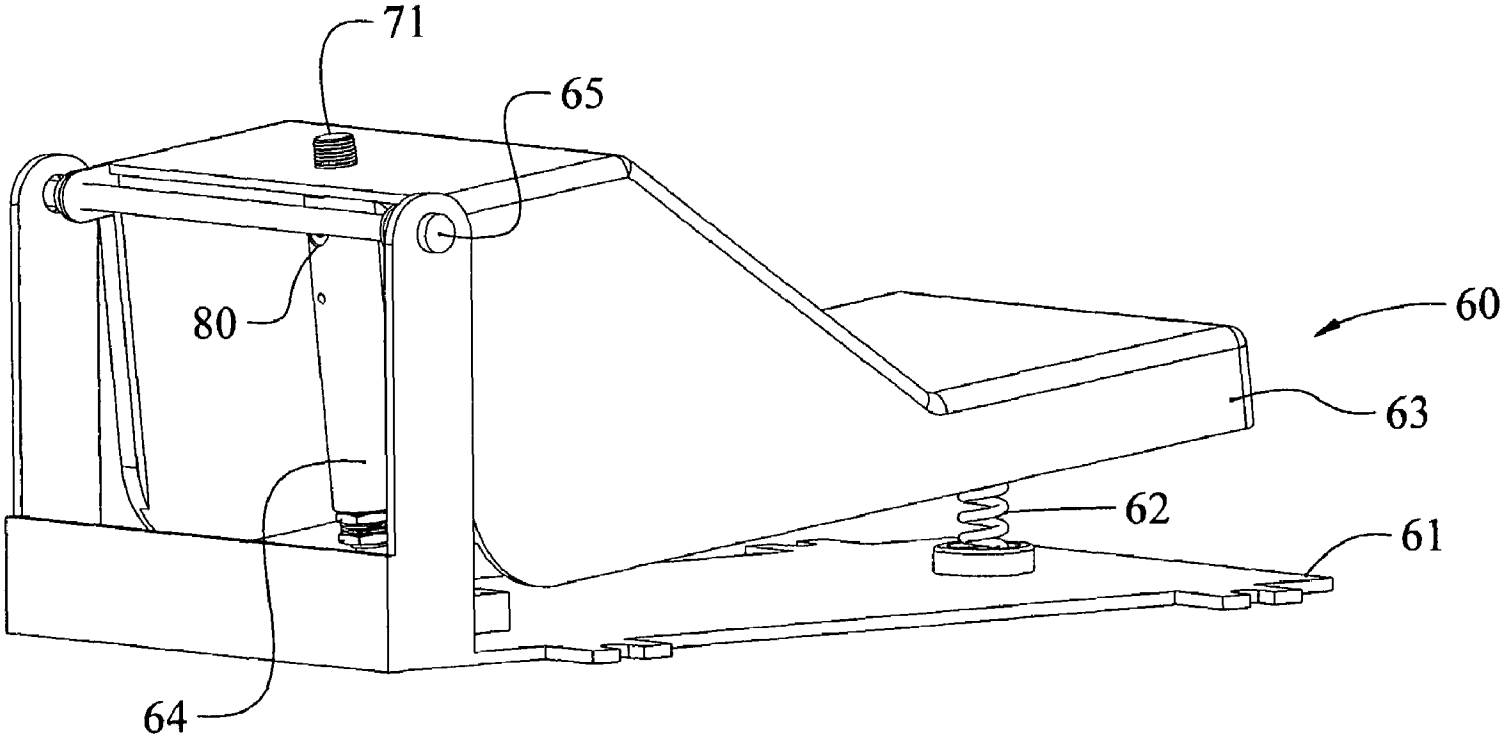
FIG. 7 shows a right perspective view of the foot operated pressure regulator.
Figure 8:
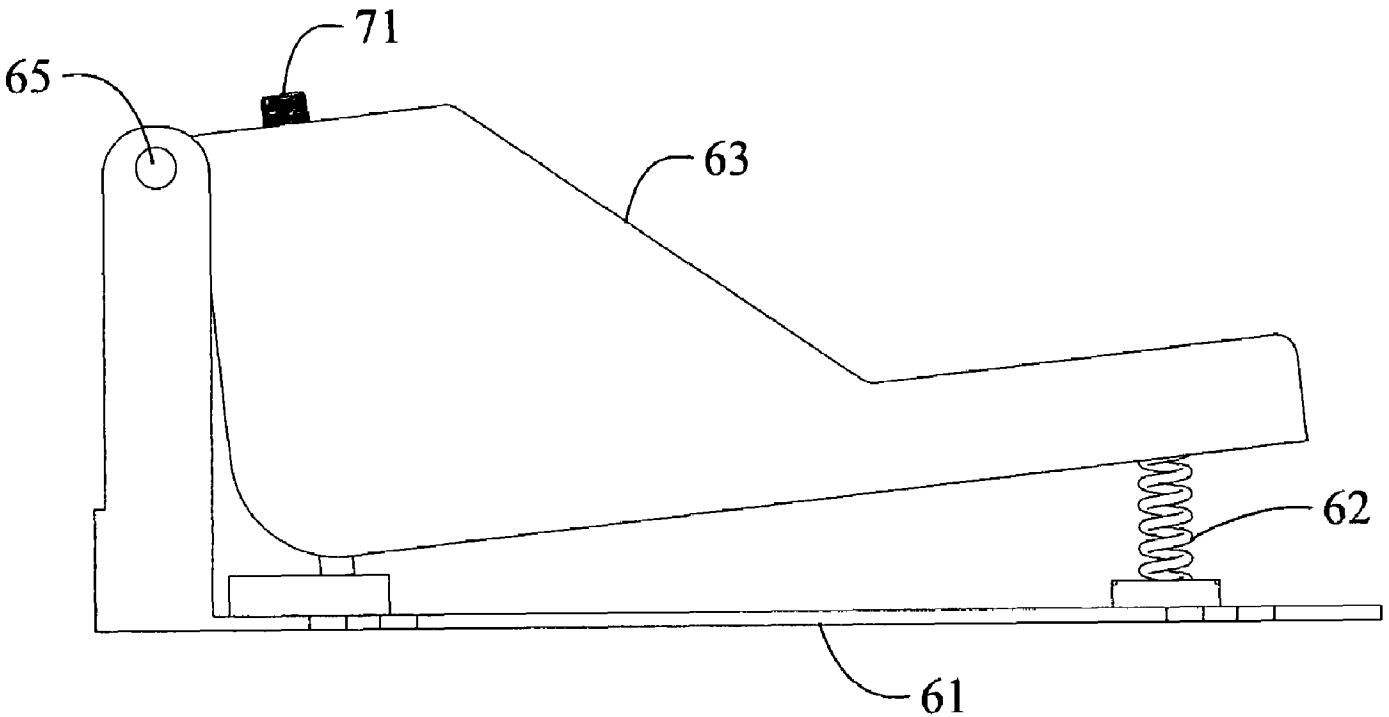
FIG. 8 shows a right plan view of the foot operated pressure regulator.
Figure 9:
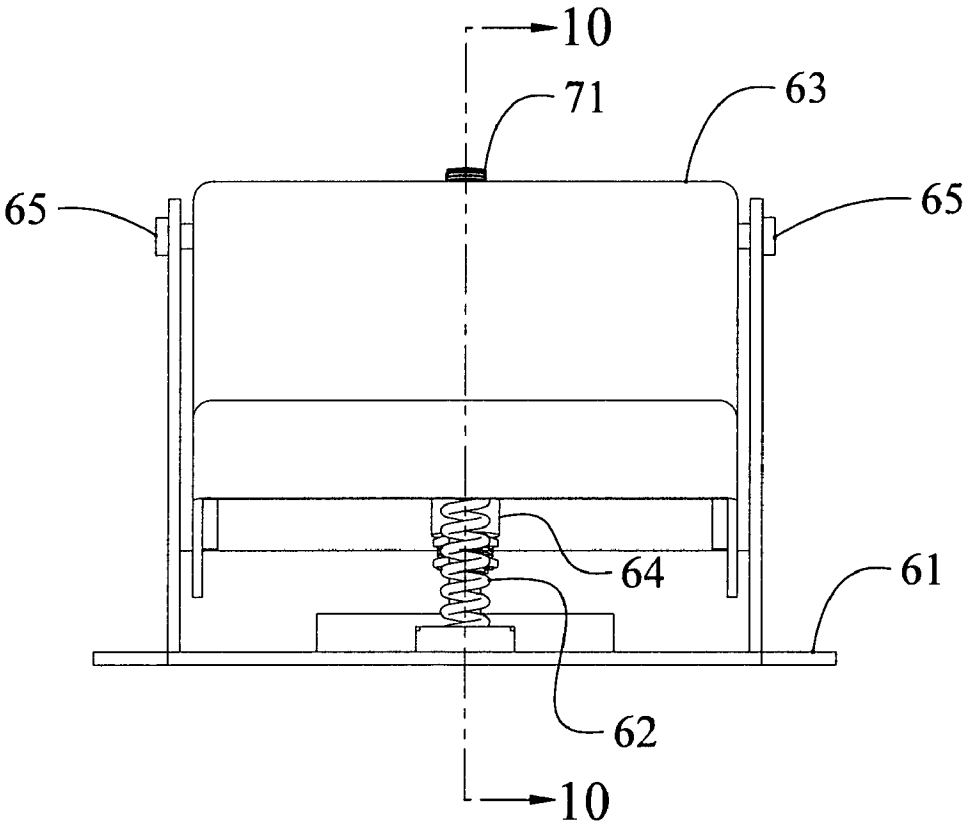
FIG. 9 shows a front plan view of the foot operated pressure regulator.

Referring now to the drawings, the rotary rolling machine 10 is shown in its preferred embodiment. The apparatus 10 is especially useful for placing beads, crimps, flanges, turns, burrs, elbows, slits, offsets, collars, flats, or other deformations in sheet metal or material whether in flat sheet form or in tubular or other forms. The type of deformation placed is dependent upon the type of rollers 28, 40 utilized with the apparatus 10.

The present art overcomes the prior art limitations by providing a rotary machine 10 with a maximum roller force commensurate with or exceeding prior art hydraulic rotary machines while utilizing only pneumatic actuation. The apparatus 10 uniquely provides the aforesaid with variable pressure regulation via a foot operated pressure regulator 60. The foot operated pressure regulator 60 easily allows a user to hold the sheet, tubular, or other type of material with two hands while controlling the force between the rollers 28, 40 and initiating motor 46 operation. Operation with only compressed air and line power with the unique construction of the apparatus 10 provides a compact, user friendly, and user safe rotary machine 10 which is easy to use and heretofore not found within the prior art.

In a preferred embodiment, the rotary machine 10 comprises a frame 12 which holds a top roller arm housing 24 and a bottom roller arm housing 36, a motor 46 and preferably a gear reducer 51 attached and held onto a bottom arm 16 of said frame 12, and an air spring or air-stroke actuator 20 positioned between the top roller arm housing 24 and a top arm 14 of said frame 12. Unique to the present art is a foot operated pressure regulator 60 which provides a variable pneumatic pressure through a pneumatic circuit to said air spring 20 whereby force between the bottom roller 40 and a top roller 28 may be precisely controlled. The foot operation via the pneumatic and electrical circuits of the apparatus 10 provide an on/off function to the motor 46 which drives the apparatus. In alternative embodiments, said motor 46 may be hydraulic or pneumatic instead of electrical or a manual crank drive, all collectively referred to as a rotational drive.

In the preferred embodiment, said top roller arm housing 24 has a top roller arm shaft 26 preferably held within bearings within said housing 24 and a top roller 28 mounted or attached at or near a first end of said shaft 26. At a second end of said shaft 26 a top roller arm gear 30 is mounted or attached which, when assembled, meshes with a bottom roller arm gear 42, collectively known as intermeshed gears 50. Also in a preferred embodiment, a shaft collar 32 having two extending pivot shafts 34, preferably in the form of pressed dowel pins, is compressively attached to said top roller arm housing 24 and said pivot shafts 34 mate with holes in said frame 12. In a preferred embodiment, the top roller arm housing 24 is pivotally held only via said pivot shafts 34 and attached via a return shaft 21 biased with a return spring 19 or equivalent with said air spring 20. This allows the top roller arm housing 24 to pivot into position and mate the top roller 28 with a bottom roller 40 via the force of said air spring 20. The compressive force of the return spring 19 held by a head (i.e. typically a nut and washer) on said return shaft 21 provides a retraction force between said rollers 28, 40 when not pressurized. Preferably said pivot shafts 34 are positioned as close to the plane of the intermeshed gears 50 as possible to eliminate binding between the intermeshed gears 50. Use of the shaft collar 32 arrangement further uniquely allows adjustment of the top roller 28 in a direction substantially perpendicular to the plane of said roller 28. This allows the user to customize the intermeshing of the rollers 28, 40 or create special effects heretofore not found in the prior art. Said pivot shafts 34 are described as dowels within the preferred embodiment but may be integral shafts formed into the housing 24 or there through or bolts or other types of shafts in alternative embodiments. Further alternative embodiments may moveably mount said top roller arm housing 24 by allowing said housing 24 to slide in grooves or guides within said frame 12.

The bottom roller arm housing 36 supports the bottom roller arm shaft 38 via bearings preferably within said housing 36. At or near a first end of said shaft 38 the bottom roller 40 is mounted or attached. At or near a second end, the bottom roller arm gear 42 which mates with said top roller arm gear 30 is mounted or attached. In the preferred embodiment the top 30 and bottom 42 roller arm gears are substantially equivalent yet alternative embodiments may utilize gears of different sizes, especially when the top 28 and bottom 40 rollers are of different sizes. Said housing 36 is preferably supported with the frame 12 via one or more bottom arm housing support(s) 44 which are attached with said frame via welds, fasteners, or other mechanical joining techniques. Alternative embodiments may attach the bottom roller arm housing 36 directly with said frame 12 and forego use of the support(s) 44 or may also allow for a pivoting of said housing 36. Further alternative embodiments may utilize chain or belt drives with associated sprockets or pulleys on said second ends of said shafts 26, 38 whereby the rotational drive (a motor 46 in the preferred embodiment) is coupled with said shafts 26, 38 and provides a rotational coupling to said shafts 26, 38.

Also in the preferred embodiment, a motor 46 having a gear reducer 51 is coupled via a flexible coupling 48 to said bottom roller arm shaft 38 at or near said second end. Alternative embodiments may not utilize the gear reducer 51 or the flexible coupling 48 and may instead directly drive one or more of the shafts 26, 38 or further drive a chain or belt connected with one or more of the shafts 26, 38. As understood within the mechanical arts, if coupled, either of the shafts 26, 38 may be driven.

The air spring (or air-stroke actuator) 20 is a subspecies of a pneumatic actuator mechanically connected between the top arm 14 of the frame 12 and the top roller arm housing 24. The air spring 20 is uniquely suited to the present application and has not heretofore been utilized with a rotary machine. Unique to the air spring 20 is the ability to provide a force between two points without the necessity of maintaining an alignment. As understood within the mechanical arts, typical piston-cylinder or plenum-shaft arrangements must maintain alignment in at least one axis perpendicular to the direction of motion in order to avoid binding. Although ball or clevis joints may be utilized with the prior art, the space occupied by such is especially prohibitive in the present art. That is, the present art air spring 20 is mounted within a very small space between the frame 12 top arm 14 and the top roller arm housing 24 and provides the necessary and desired force between the rollers 28, 40 via the pivoting of the top roller arm housing 24. The force is provided, notwithstanding any lateral movement of the top roller arm housing 24, without binding. When not pressurized, the return spring 19 in conjunction with the return shaft 21 allows the air spring 20 to decompress and further allows the top roller 28 to disengage from the bottom roller 40 via the natural retraction force provided by said air spring 20 upon the top roller arm housing 24. Utilizing the air spring (or air-stroke actuator) 20 typically as manufactured by companies such as Firestone® or Goodyear®, provides extraordinary force (due to the large circumferential surface area) in a small package without the tolerance requirements of traditional force generation methods and without the need for hydraulics and associated hydraulic pumps.

In the preferred embodiment, a housing plate 22 is attached via welds, bolts, or other means to said top roller arm housing 24 to facilitate a mating interface (preferred embodiment) or mounting (alternative embodiments) of an end of said air spring 20 to the housing 24 tubular structure. The opposite end of said air spring 20 is preferably mounted via screws or bolts to a substantially flat portion of said frame 12 top arm 14. Said air springs, as commercially available, typically have a small plate having threaded holes at each end into which a bolt or fastener may be placed for securing the air spring to the application. The preferred embodiment of the present art places a plurality of holes on said top arm 14 of said frame 12 whereby a plurality of sizes of airs springs may be used with the machine 10. This is especially useful for fine roller 28, 40 force control with work materials of different thicknesses or compositions. A pneumatic input port is usually located in the small plate and feeds pneumatic pressure to the air spring. Although utilized in the present art, alternative embodiments may forego use of said threaded holes and attach the ends of said air spring 20 via a plurality of methods including but not limited to welds, cages, indentations, journals, or other forms which maintain the air spring 20 in position.

The preferred form of the present invention has a material fence 52, preferably adjustable, positioned near said rollers 28, 40. The fence 52 guides an edge or portion of the work material whereby a substantially straight bead or other roller induced form may be placed by the operator. In the preferred form, the fence 52 comprises one or more support shafts 54 compressively held and supported by one or more support rings 58 which are attached, preferably via welding, to a fence support collar 56. Also in a preferred embodiment, said fence support collar 56 compressively attaches with the bottom roller arm housing 36. As preferred and shown, said rings 58 and collar 56 are either single or double split collars which compress and hold via setscrews within the periphery. Alternative embodiments may utilize a plurality of methods and forms to adjustably mount said fence 52 including but not limited to direct attachment with the frame 12, attachment with the top roller arm housing 24, or mounting with a stand upon which the machine 10 is placed. Further alternative embodiments may forego use of the fence 52 and allow the operator to manually guide the work material.

Figure 10:
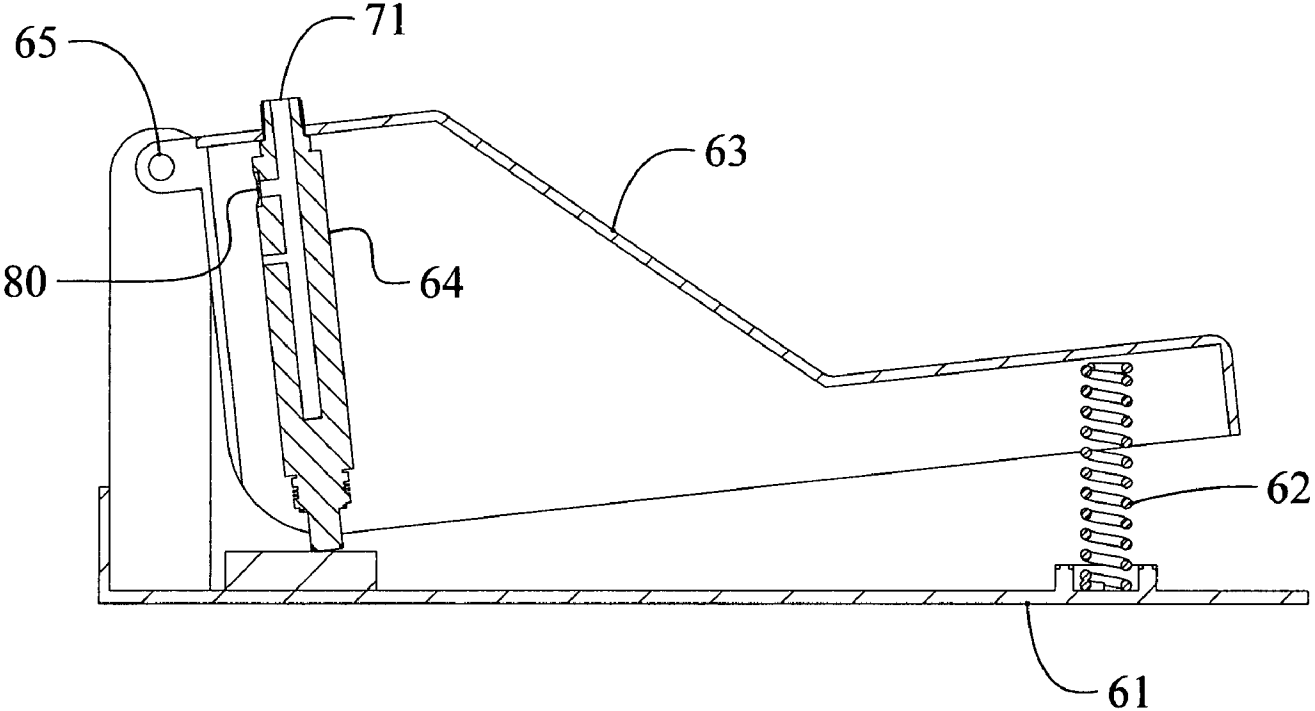
FIG. 10 shows a cross sectional view taken along line 10-10 of FIG. 9. The cross section of the stem regulator does not show the internal components.
Figure 11:
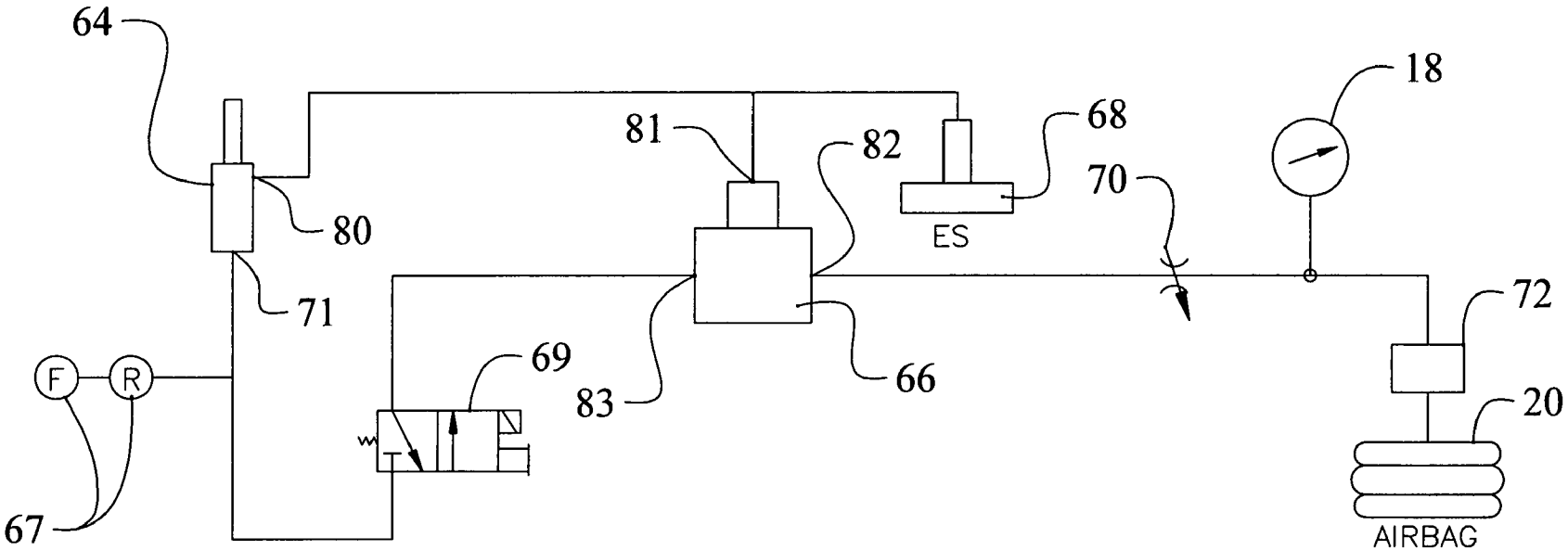
FIG. 11 shows a pneumatic schematic for the improved rotary rolling machine.
Figure 12:
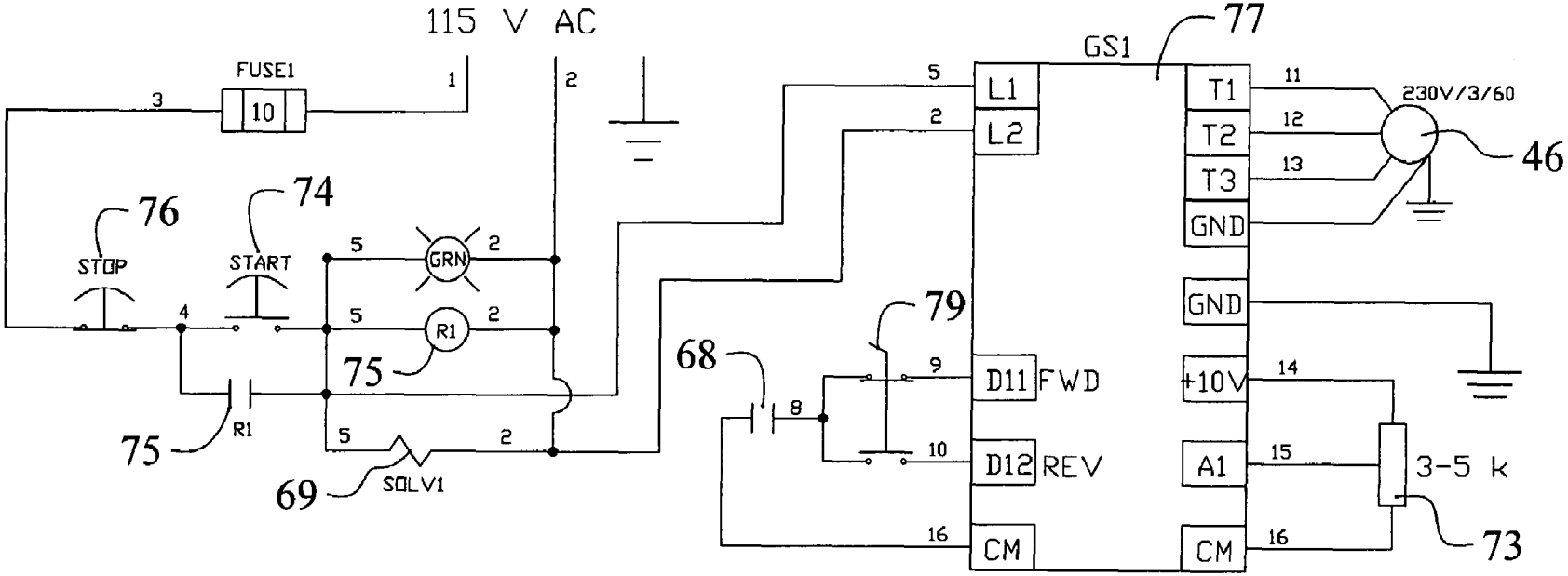
FIG. 12 shows an electrical schematic for the improved rotary rolling machine.

Unique to the present art is a foot operated pressure regulator 60 which, in conjunction with the associated pneumatic and electrical components, provides a user or operator controlled variable and increasing force between the rollers 28, 40 via only user foot action with a minimal complexity of components. That is, the output pressure of the regulator 60 is variable and a function of the user's foot displacement and increases as said displacement increases thereby providing an increasing variable force between said rollers 28, 40. The foot operated pressure regulator 60 comprises a regulator base 61 and a regulator housing 63 which pivots upon one or more pivot points or shafts 65 with said base 61 and between which is mounted a stem regulator 64. Said stem regulator 64 is an MAR-1 CP manufactured by Clippard Instrument Laboratory, Inc. of Cincinnati, Ohio in a preferred embodiment. The uniquely small dimensions of the linear form regulator 64 allows mounting within a small foot fitting housing and, until recently, has been unavailable in such a small size. It is important to note that the stem regulator 64 as utilized is a true regulator and not simply a valve. It provides a variable pressure output at an output port 80 (from an input port 71 supplied with a pneumatic supply 67) as a function of stem depression and atmospherically vents the output port 80 when released. Also in the preferred form, a return spring 62 is placed between said base 61 and housing 63 to assure shutoff of said regulator when the housing 63 is not depressed. Alternative embodiments may utilize the stem regulator 64 for foot actuation in a plurality of ways including but not limited to direct displacement by an operators foot without a housing or via different form housings which utilize cam mechanisms. Said stem regulator 64 as seen in a cross section of FIG. 10 typically has a third port which vents the output port 80 to atmosphere when not activated.

The input port 71 of the stem regulator 64 is supplied with compressed air from the pneumatic supply 67, preferably pressure regulated, and the regulated output 80 of such drives a pneumatic electrical switch 68 and a pilot port 81 of a pilot regulator 66, all in the preferred embodiment. When a nominal threshold pressure is reached, typically 4-5 pounds per square inch (psi), the pneumatic electrical switch 68 closes and activates the electronics which drive the motor 46 in a manner controlled and desired by the operator. The nominal threshold pressure may be more or less in alternative embodiments. The pilot regulator 66 allows the variable pressure from the stem regulator 64 to control a larger volume and flow of pneumatic pressure to a pneumatic port on the air spring 20 via a pilot regulator output port 82 fed by a pilot regulator input port 83. That is, output port 82 feeds the pneumatic input or port of the air spring 20. The operation is similarly analogous to a somewhat unity gain voltage amplifier having a larger output current drive in the electronic arts. In a preferred embodiment said pilot regulator 66 is a commercially available series 22 or 32 manufactured by Numatics or Highland, Mich. or equivalent. Alternative embodiments, especially in smaller applications, may forego use of the pilot regulator and drive the airbag or air spring 20 directly. For the present art, the interposed pneumatic components between the stem regulator 64 output port 80 and the air spring 20 or equivalent, whether a direct connection or via other valves or regulators, is known as the pneumatic circuit.

In the preferred embodiment a flow controller 70 and quick exhaust 72 is placed in the pneumatic line between the pilot regulator 66 output port 82 and the air spring 20. The flow controller 70 is a commercially available pneumatic component which limits the pneumatic inrush flow in order to limit the velocity with which the top roller 28 mates with the bottom roller 40. The flow controller 70 does not limit the pressure provided to the air spring 20 but simply assures that the displacement versus time is controlled. The quick exhaust 72 is also a commercially available component which vents the air spring 20 when the input line pressure is removed. This allows for a quick retraction of the top roller 28 from the bottom roller 40 when the operator desires disengagement. Also in a preferred embodiment, a pressure gauge 18 is placed in the pneumatic line between the pilot regulator 66 (or stem regulator 64 in an alternative embodiment) and the air spring 20 and preferably mounted in a visible location upon said frame 12. The gauge 18 allows the user to visually determine the pressure within the air spring 20 during use and thereby allows application of a repeatable force between the rollers 28, 40. That is, the force between the rollers 28, 40 is substantially proportional to the pressure within the air spring 20.

Also in the preferred embodiment is a pneumatic-electric solenoid valve 69 pneumatically connected and positioned between the pneumatic supply 67 and the input port 83 of the pilot regulator 66. This valve 69 assures that pneumatic pressure is applied to the pilot regulator 66 only after the operator depresses or activates a start contactor 74. That is, if the operator has not turned on the machine 10, pneumatic pressure is denied to the pneumatic circuit. This provides an extra measure of safety when the operator is setting up the machine 10 and also assures that the work material is not inadvertently damaged or deformed prior to initiating a rolling or other operation. Alternative embodiments may forego use of the solenoid valve 69 or use an equivalent pneumatic, electrical, or mechanical element to provide the safety and operational features described.

Electrically the preferred embodiment utilizes an inverter drive 77 to drive a preferably three phase motor 46 which further drives the roller shafts 26, 38. In a preferred embodiment the inverter drive 77 is an Automation Direct (of Cumming, Ga.) model GS1-10P5 or equivalent which utilizes a single phase 220 volt AC input provided at terminals or pins 5 & 2 (i.e. L1 & L2) to drive the 230 volt three phase motor 46. A speed controller 73, preferably in the form of a 5 kΩ potentiometer, is connected between terminals or pins 14-16 with the wiper connected with terminal 15 of the drive 77 whereby the operator may control the speed of the motor 46. Typically the operator sets the speed prior to beginning a work operation. A forward-reverse switch 79 selectively connects terminals or pins 9 or 10 of the drive 77 through the pneumatic electrical switch 68 to a common at terminal or pin 16 of the drive 77. When the pneumatic electrical switch 68 closes the circuit between either the forward (FWD) terminal or pin or the reverse (REV) terminal or pin, the motor 46 begins rotation respectively. Alternative embodiments may utilize a plurality of forms to drive the motor 46 including but not limited to direct single or three phase drives, pneumatics, or hydraulics.

As apparent to one skilled in the art, prior to the drive 77 is the start and stop switching circuits along with the electrical energizing coil of the solenoid valve 69. When depressed, the start contactor 74 energizes the coil of a latching relay 75 which shunts the start contactor 74, provides continuous power to the drive 77, continuously energizes the solenoid valve 69, and further energizes a light to indicate that power is on and the machine 10 is ready for operation via the foot operated pressure regulator 60. That is, when ready for operation, the pneumatic supply 67 is pneumatically connected with the pilot regulator 66 (or stem regulator 64 in an alternative embodiment). A stop contactor 76 is provided inline prior to any of the aforementioned circuitry which when depressed denies power to the system and allows the latching relay 75 to release whereby power cannot be restored to the system until the operator depresses the start contactor 74.

In operation, the user or operator first connects an pneumatic compressed air supply 67 to the machine 10 of the present art and depresses or activates the start contactor 76. Prior to this operation, the operator may loosen the preferably two piece shaft collar 32 on the top roller arm housing 24 and adjust the position of the top roller 28 relative to the bottom roller 40 to achieve specialized or custom rolling forms. This adjustability feature is possible due to the use of the air spring 20 (air bag) as the actuator since the air spring 20 is not alignment sensitive or susceptible to binding such as the prior art devices. The user may, if necessary or desired, adjust the speed controller 73 to specify the desired motor 46 speed.

When the aforesaid operations are completed, the machine 10 is ready for operation. The operator places a sheet work material (in flat, tubular, or other forms) between the rollers, is able to hold the work material with two hands, and depresses the foot operated pressure regulator 60. Upon supply of a nominal (typically 4-5 psi or more or less in alternative embodiments) pressure to the pneumatic electrical switch 68 from said regulator 60, the motor 46 begins operation thereby driving the rollers 28, 40 and the top roller 28 approaches the bottom roller 40 with the work material there between. As the operator further depressed the foot operated pressure regulator 60, the force between the rollers increases thereby increasing the amount of deformation imparted upon the work material. In the preferred embodiment, if the operator desires a repeatable visual reference of force applied other than the amount of work material deformation, he or she simply observes the pressure gauge 18 and controls such with the foot regulator 60. Heretofore such precise, safe, convenient, and flexible control of roller force and mating has not been found in the prior art rotary or bead rolling machines.

From the foregoing description, those skilled in the art will appreciate that all objects of the present invention are realized. An improved rotary rolling or bead rolling machine 10 is shown and described. The present art machine 10 is especially suited for placing beads, crimps, flanges, turns, burrs, elbows, slits, offsets, collars, flats, or other deformations in sheet metal or material whether in flat sheet form or in tubular or other forms. It uniquely allows an operator to control the deformation severity (i.e. roller force) in real time without sacrificing two handed operation and further allows the rollers to be offset when required for specialty operations. With the utilization of an air spring or air-stroke actuator 20 the applied roller force value is commensurate with or exceeds the prior art without the unnecessary complexity and bulk of hydraulic actuation. All of the aforementioned benefits are also provided with the present art in a volumetric size which is substantially smaller than the prior art and of less weight.

Having described the invention in detail, those skilled in the art will appreciate that modifications may be made to the invention without departing from its spirit. Therefore, it is not intended that the scope of the invention be limited to the specific embodiments illustrated and described. Rather it is intended that the scope of this invention be determined by the appended claims and their equivalents.

What is claimed is:

1. A rotary rolling machine comprising:

a frame having a top arm; and a top roller arm housing pivotally attached with said frame; and said top roller arm housing having a top roller arm shaft having a top roller at or near a first end of said top roller arm shaft; and a bottom roller arm housing attached with said frame; and said bottom roller arm housing having a bottom roller arm shaft having a bottom roller at or near a first end of said bottom roller arm shaft; and said top roller arm shaft and said bottom roller arm shaft having a rotational coupling; and a rotational drive capable of driving one or more of said shafts; and an air spring having an ability to provide a force between two points without a necessity of maintaining a substantial alignment and positioned between said top arm of said frame and said top roller arm housing whereby said rollers substantially engage and a force is present between said rollers when said air spring is pressurized.

2. The rotary rolling machine as set forth in claim 1 further comprising:

a foot operated pressure regulator having an input port connected with a pneumatic supply and an output port connected through a pneumatic circuit with a pneumatic port of said air spring; and said output port of said foot operated pressure regulator capable of supplying an increasing variable pneumatic pressure as a function of an operator's foot displacement whereby said increasing variable pneumatic pressure through said air spring creates an increasing variable force between said rollers.

3. The rotary rolling machine as set forth in claim 2 whereby:

said rotational drive comprises a motor coupled with said bottom shaft or said top shaft.

4. The rotary rolling machine as set forth in claim 3 whereby:

said rotational coupling comprises a top roller arm gear attached at or near a second end of said top roller arm shaft and a bottom roller arm gear attached at or near a second end of said bottom roller arm shaft; and said gears substantially intermeshed whereby if one of said shafts is driven the other shaft is also driven.

5. The rotary rolling machine as set forth in claim 2 whereby said foot operated pressure regulator further comprises:

a regulator base and a regulator housing pivotally mounted with said regulator base; and a stem regulator positioned between said regulator base and said regulator housing.

6. The rotary rolling machine as set forth in claim 2 further comprising:

a pilot regulator having a pilot port, an output port, and an input port; and said pilot port pneumatically connected with said output port of said foot operated pressure regulator; and said input port of said pilot regulator pneumatically connected with said pneumatic supply; and said output port of said pilot regulator pneumatically connected with said pneumatic port of said air spring.

7. The rotary rolling machine as set forth in claim 3 further comprising:

a pneumatic electrical switch pneumatically connected with said output port of said foot operated pressure regulator and electrically connected with a drive for said motor whereby a nominal pressure from said regulator causes operation of said motor.

8. The rotary rolling machine as set forth in claim 1 further comprising:

a shaft collar compressively attached with said top roller arm housing and having one or more pivot shafts pivotally mounted with said frame; and said shaft collar capable of allowing adjustment of said top roller in a direction substantially perpendicular to a plane of said top roller.

9. A rotary rolling machine comprising:

a frame having a top arm; and a top roller arm housing pivotally attached with said frame; and said top roller arm housing having a top roller arm shaft having a top roller at or near a first end of said top roller arm shaft; and a bottom roller arm housing attached with said frame; and said bottom roller arm housing having a bottom roller arm shaft having a bottom roller at or near a first end of said bottom roller arm shaft; and said top roller arm shaft and said bottom roller arm shaft having a rotational coupling; and a rotational drive capable of driving one or more of said shafts; and an air spring mechanically connected and substantially positioned between said top arm of said frame and said top roller arm housing whereby said rollers substantially engage and a force is present between said rollers when said air spring is pressurized; and said air spring having an ability to provide a force between two points without a necessity of maintaining a substantial alignment; and a foot operated pressure regulator having an input port connected with a pneumatic supply and an output port connected through a pneumatic circuit with a pneumatic port of said air spring; and said output port of said foot operated pressure regulator capable of supplying an increasing variable pneumatic pressure as a function of an operator's foot displacement whereby said increasing variable pneumatic pressure through said air spring creates an increasing variable force between said rollers.

10. The rotary rolling machine as set forth in claim 9 whereby said rotational drive further comprises:

a motor coupled with said bottom roller arm shaft and driven by a drive; and an pneumatic electrical switch connected pneumatically with said foot operated pressure regulator output port and connected electrically across two or more terminals of said drive whereby said drive energizes said motor when a nominal pressure from said regulator is sensed by said switch.

11. The rotary rolling machine as set forth in claim 10 whereby said foot operated pressure regulator further comprises:

a regulator base and a regulator housing pivotally mounted with said regulator base; and a stem regulator mounted between said regulator base and said regulator housing and having an input port and output port which form said input port and output port of said foot operated pressure regulator.

12. The rotary rolling machine as set forth in claim 11 further comprising:

a pilot regulator having an input port, an output port, and a pilot port; and said pilot port pneumatically connected with said stem regulator output port; and said pilot regulator input port pneumatically connected with said pneumatic supply; and said pilot regulator output port connected with a pneumatic port on said air spring.

13. The rotary rolling machine as set forth in claim 12 further comprising:

A flow controller pneumatically connected between said pilot regulator output port and said air spring pneumatic port whereby an pneumatic inrush flow is limited in order to limit a velocity with which said top roller mates with said bottom roller.

14. The rotary rolling machine as set forth in claim 13 further comprising:

a quick exhaust pneumatically connected between said flow controller and said air spring pneumatic port whereby said air spring is vented when a line pressure is substantially removed and a quick retraction of said top roller from said bottom roller occurs.

15. The rotary rolling machine as set forth in claim 14 further comprising:

a material fence adjustably positioned near said rollers and having fence one or more support shafts; and a fence support collar attached with said bottom arm housing and having one or more support rings; and said one or more support rings capable of holding said one or more support shafts.

16. The rotary rolling machine as set forth in claim 10 further comprising:

a shaft collar compressively attached with said top roller arm housing and having one or more pivot shafts pivotally mounted with said frame; and said shaft collar capable of allowing adjustment of said top roller in a direction substantially perpendicular to a plane of said top roller.

17. The rotary rolling machine as set forth in claim 16 whereby said rotational drive further comprises:

a motor coupled with said bottom roller arm shaft and driven by a drive; and an pneumatic electrical switch connected pneumatically with said foot operated pressure regulator output port and connected electrically across two or more terminals of said drive whereby said drive energizes said motor when a nominal pressure from said regulator is sensed by said switch.

18. The rotary rolling machine as set forth in claim 17 further comprising:

a pilot regulator having an input port, an output port, and a pilot port; and said pilot port pneumatically connected with said foot operated pressure regulator output port; and said pilot regulator input port pneumatically connected with said pneumatic supply; and said pilot regulator output port connected with a pneumatic port on said air spring.

19. The rotary rolling machine as set forth in claim 18 further comprising:

A flow controller connected between said foot operated pressure regulator output port and said air spring pneumatic port whereby a pneumatic inrush flow is limited in order to limit a velocity with which said top roller mates with said bottom roller.

20. The rotary rolling machine as set forth in claim 19 further comprising:

a quick exhaust pneumatically connected between said flow controller and said air spring pneumatic port whereby said air spring is vented when a line pressure is substantially removed and a quick retraction of said top roller from said bottom roller occurs.

* * * * *